US011585146B2

(12) United States Patent
Lange

(10) Patent No.: US 11,585,146 B2
(45) Date of Patent: Feb. 21, 2023

(54) BUILDING ENVELOPE

(71) Applicant: Michael Lange Ingenieurgesellschaft mbH, Hannover (DE)

(72) Inventor: Michael Lange, Hannover (DE)

(73) Assignee: PROF. MICHAEL LANGE INGENIEURGESELLSCHAFT MBH, Hanover (DE)

( * ) Notice: Subject to any disclaimer, the term of this patent is extended or adjusted under 35 U.S.C. 154(b) by 0 days.

(21) Appl. No.: 17/258,718

(22) PCT Filed: Jul. 10, 2018

(86) PCT No.: PCT/EP2018/068630

§ 371 (c)(1),
(2) Date: Jan. 7, 2021

(87) PCT Pub. No.: WO2020/011338

PCT Pub. Date: Jan. 16, 2020

(65) Prior Publication Data

US 2021/0230929 A1 Jul. 29, 2021

(51) Int. Cl.
*E04B 2/88* (2006.01)
*E06B 3/26* (2006.01)
(Continued)

(52) U.S. Cl.
CPC ..... *E06B 3/2605* (2013.01); *E04B 2/88* (2013.01); *E06B 3/66376* (2013.01); *E06B 3/6722* (2013.01); *E06B 2009/2643* (2013.01)

(58) Field of Classification Search
CPC ..... E04B 2/88; E04B 2/90; E04B 2/96; E06B 3/2605; E06B 3/6722; E06B 2009/2405;
(Continued)

(56) References Cited

U.S. PATENT DOCUMENTS 6,237,290 B1 * 5/2001 Tokimoto ..... G09F 19/226 52/236.3
11,225,804 B1 * 1/2022 Rowland ..... F24F 1/60
(Continued)

FOREIGN PATENT DOCUMENTS

DE 202008003804 U1 6/2009
EP 3264241 A1 1/2018
WO 2010148587 A1 12/2010

OTHER PUBLICATIONS

English Translation of International Search Report (with Written Opinion) of the International Searching Authority, dated Apr. 9, 2019, with respect to International Application No. PCT/EP2018/068630.

(Continued)

*Primary Examiner* — Kyle J. Walraed-Sullivan
(74) *Attorney, Agent, or Firm* — Scott R. Cox

(57) ABSTRACT

A curtain wall having a frame construction with a plurality of glass elements and optionally panels arranged at a distance from each other in a heat flow direction, wherein a multifunctional glass element is arranged on a room side behind a main heat-insulating plane of the curtain wall, wherein the position of the multifunctional glass element can be modified in a vertical direction and/or a horizontal direction and the multifunctional glass element has at least two of the functions selected from the following list: (A) anti-glare protection in a form of modifiable or switchable layers, (B) heating capacity at least in section, (C) a configuration with integrated LEDs as room lighting, (D) a configuration as an information system, particularly as a screen, at least in sections, (E) a configuration with at least one integrated camera, and (F) a configuration with at least one integrated loudspeaker.

15 Claims, 10 Drawing Sheets

(51) Int. Cl.
*E06B 3/663* (2006.01)
*E06B 3/67* (2006.01)
*E06B 9/264* (2006.01)

(58) Field of Classification Search
CPC ..... E06B 2009/2417; E06B 2009/2435; E06B 2009/2477; E06B 2009/2452; E06B 2009/2458; E06B 2009/2464; E06B 2009/247; G09F 19/226
See application file for complete search history.

(56) References Cited

U.S. PATENT DOCUMENTS

2004/0040228 A1* 3/2004 Emde ..... B32B 17/10165 52/173.3
2005/0105303 A1* 5/2005 Emde ..... B32B 17/10045 362/616
2006/0150514 A1* 7/2006 Miller ..... E05C 9/002 49/394
2009/0128461 A1* 5/2009 Geldard ..... G09F 19/226 345/84
2009/0268450 A1* 10/2009 Kojoh ..... F21K 9/00 362/235
2011/0047875 A1* 3/2011 Kelley ..... E06B 3/28 49/63
2011/0058113 A1* 3/2011 Threlkel ..... G09F 19/22 349/1
2013/0100675 A1* 4/2013 Han ..... F21V 33/006 362/253
2013/0242370 A1* 9/2013 Wang ..... G02F 1/1533 359/275
2014/0232958 A1* 8/2014 Venturas ..... G02F 1/133615 349/12
2014/0259931 A1* 9/2014 Plummer ..... G08C 17/02 49/70
2016/0154290 A1* 6/2016 Brown ..... H04L 12/2803 359/275
2017/0052289 A1* 2/2017 Boissevain ..... H05B 47/11
2017/0130523 A1* 5/2017 Shrivastava ..... E06B 3/6715
2017/0236458 A1* 8/2017 Kim ..... G09F 11/21 52/31
2018/0144712 A1* 5/2018 Threlkel ..... G09F 9/35
2018/0182314 A1* 6/2018 Staton ..... G09G 3/20
2018/0284555 A1* 10/2018 Klawuhn ..... G02F 1/163
2019/0272777 A1* 9/2019 Oh ..... G09F 11/025
2020/0057421 A1* 2/2020 Trikha ..... B32B 17/10055
2020/0150508 A1* 5/2020 Patterson ..... H02J 50/80
2020/0332593 A1* 10/2020 Ribberink ..... H02S 40/22
2020/0340299 A1* 10/2020 Snader ..... E06B 3/2605
2021/0254823 A1* 8/2021 Gainanova ..... F21S 4/28
2021/0349480 A1* 11/2021 Rebarchek ..... G01S 15/88
2021/0390953 A1* 12/2021 Makker ..... G06F 3/04883

OTHER PUBLICATIONS

English Translation of International Preliminary Report on Patentability of the International Searching Authority, dated Feb. 13, 2020, with respect to International Application No. PCT/EP2018/068630.

* cited by examiner

BUILDING ENVELOPE

RELATED APPLICATIONS

This Application is a national stage filing under 35 U.S.C. § 371 of International Patent Application Serial No. PCT/EP2018/068630, filed Jul. 10, 2018. The entire contents of this application is incorporated herein by reference in its entirety.

FIELD OF THE INVENTION

The invention relates to a building envelope comprising a curtain wall having a frame construction with a plurality of glass elements and panels in the parapet area.

PRIOR ART

Curtain walls are well-known in the prior art and configured as a post and beam front, unitized front or cold-warm front. An example of a curtain wall is known from WO 2010/148587 A1.

In post and beam fronts, the assembly of the frames from post profiles and beam profiles with glass panes or panels as infill elements is carried out on the construction site by fixing the post profiles to the building shell, fixing the beam profiles to the post, and inserting the filling elements into the framework.

In a unitized front, already prefabricated front elements made of frame profiles and glass panes and/or panels are fixed to the building shell as infill elements.

In a cold-warm front, window hinges are mounted on buildings with solid parapets, and the solid, heat-insulated parapets are clad with framed infills made of glass or sheet metal.

All curtain walls are based on the general principle that a framework is provided with integrated elements fixed in the framework. The elements can be windows made of insulating glass or heat-insulated panels. The windows can be openable, but are often non-openable fixed panels. The glasses are usually configured as double or triple glazing. Glass panes with modifiable properties are increasingly used in front construction. One possible configuration of a modifiable glass pane is the provision of switchable layers, by means of which the light permeability of the glass can be adjusted. Moreover, transparent casting resin laminated glasses with integrated LEDs have become known in the prior art, which can be used as media glass fronts towards the outside as advertising media.

The laminated glass according to DE 20 2008 003 804 U1 comprises two glass elements, between which a decorative layer and optionally light-emitting diodes are located.

The glass element described in EP 3 264 241 A1 has a touch-sensitive layer between two glass panes, which controls an integrated lighting by light-emitting diodes.

DESCRIPTION OF THE INVENTION

The invention is based on the object of developing a building envelope comprising a curtain wall, which—in contrast to that known so far—has a significantly higher variability and in particular offers various additional functionalities for the people in the corresponding building.

This object is solved by a building envelope having the features of claim 1.

The building envelope according to the invention has a frame construction with a plurality of glass elements arranged at a distance from each other in the heat flow direction, wherein a multifunctional glass element is arranged on the room side behind the main heat-insulating plane of the curtain wall. In this respect, the position of the multifunctional glass element can be modified in the vertical direction and/or the horizontal direction. This also includes the case that the multifunctional glass element can only be moved for cleaning and/or repair purposes. Moreover, the multifunctional glass element has at least two of the functions from the list comprising (A) anti-glare protection in the form of modifiable or switchable layers;

(B) heating capacity at least in sections;

(C) a configuration with integrated LEDs as room lighting;

(D) a configuration as an information system, particularly as a screen, at least in sections;

(E) a configuration with at least two integrated cameras; and (F) a configuration with at least two integrated loudspeakers.

In order to be able to use some of the functionalities meaningfully, the position of the multifunctional glass element is selected such that it lies on the room side behind the main heat-insulating plane of the curtain wall. In other words, the multifunctional glass element is provided in addition to the glass elements of the curtain wall arranged towards the outside of the front and is arranged towards the inside of the front. Depending on the climatic conditions, the heat flow direction goes from the inside of the front to the outside or vice versa. Another important aspect of the variability of the multifunctional glass element is that optionally its position can be modified in the vertical direction and/or the horizontal direction. This variability is not possible in front constructions with a multifunctional glass pane arranged towards the outside of the front as an integral part of the curtain wall. Moreover, the multifunctional glass element has at least two of the aforementioned functions, wherein preferably at least three and particularly preferably at least four of the functions are realized.

The main heat-insulating plane permanently separates the outdoor climate and the indoor climate from each other. In the present case, the main heat-insulating plane consists of the heat-insulated frame profiles and the infills in the form of insulating glasses and heat-insulated panels, which are integrated therein. It is also possible that no panels are installed in the parapet area, but that the insulating glass elements are multi-part or one-part infills over the entire storey height. The separation between outdoor climate and indoor climate is primarily to be understood in terms of heat technology; however, the separation also lies in reduced air permeability, sufficient impermeability to driving rain and optionally sound insulation.

Due to the arrangement of the multifunctional glass element on the room side behind the main heat-insulating plane, anti-glare protection provided in the multifunctional glass element does not hinder passive solar energy utilization in winter. In addition, a very flexible configuration and use is possible.

Additional advantages of the arrangement of the multifunctional glass element behind the main heat-insulating plane are the longer lifetime of the multifunctional glass element due to the weather-protected position and the associated lower cleaning effort due to less dirt. The cleaning effort is also further reduced by the better accessibility of the multifunctional glass element, which reduces the cleaning costs to be incurred.

The multifunctional glass element can be divided into a plurality of individual glass panes which, due to the modifiable position of the multifunctional glass element, can be brought into a position best suited for the respective function, depending on the requirement.

Thus, it is possible to provide a single function per glass pane and to divide the multifunctional glass element into a plurality of individual elements, so that the multifunctional glass element as a whole fulfills a plurality of functions.

Similarly, however, it is also possible to combine all functions in a single glass pane. The multifunctional glass element is preferably a laminated glass pane with two glass panes and an intermediate layer. Similarly, when numerous functionalities are provided, the laminated glass pane can also comprise at least three glass panes with two intermediate layers. Likewise, two laminated glass panes can be provided, among which the functions are distributed. Thus, the multifunctional glass element can consist of a single component or, alternatively, can comprise several multifunctional glass elements. A laminated glass pane consists of at least two individual glass panes which are joined with each other by means of an intermediate film or a different transparent adhesive, preferably a casting resin, as an adhesive intermediate layer. The thickness of an intermediate film usually starts with a film thickness of 0.38 mm. With multiple layers of an intermediate film, however, significantly higher thicknesses can also be realized, which can be adjusted to the elements to be embedded in the intermediate layer.

For example, if four functions are to be provided in a single laminated glass pane, these are usually integrated into the intermediate layer. Similarly, individual functions can be integrated into the individual glass panes of a laminated glass as an alternative or in addition. Thus, two functions can be provided in each glass pane of the laminated glass, but a 3:1 distribution between the two glass panes can also be selected. When providing all six functions, any distribution can be selected as well, which can go from an even 3:3 distribution to a 1:5 distribution. Any distribution between the intermediate layer and the individual glass panes is possible, as long as it is technically meaningful. For example, it is technically meaningful to arrange integrated loudspeakers towards the inside of the room. Moreover, functions can be integrated into the intermediate layer or intermediate layers between the individual glass panes of the laminated glass pane.

According to an alternative preferred embodiment of the invention, the multifunctional glass element is a double-glazed pane with an intermediate space between 4 mm and 20 mm between the panes, wherein the individual panes can preferably be moved separately with respect to their position. Once again, any distribution of the functions among the individual glass panes of the double-glazed pane is possible.

In principle, it is also possible to use an insulating glass pane as a multifunctional glass element, which is also arranged on the room side behind the main heat-insulating plane. All embodiments of the invention which have been described so far have in common that several functions of the multifunctional glass element can be arranged in spatially separated areas. This advantageous arrangement in spatially separated areas makes sense since, for example, the function of heating capacity at least in sections is preferably arranged at those points which are located near the floor of a room adjoining the curtain wall on the inside. Conversely, anti-glare protection is often provided in a central area in relation to the room height in order to be effective for seated or standing people, but without darkening too much a room located on the inside of the front. Integrated LEDs as room lighting can be meaningfully arranged at various points, but are often located, with respect to a room, on the inside of the curtain wall in an area close to the room ceiling.

According to the invention, the individual functions can be arranged either in separated areas of the multifunctional glass element or in overlapping areas. A typical example of an overlapping area is the provision of room lighting with integrated LEDs, which can be provided in the area of anti-glare protection.

The multifunctional glass element according to the invention is preferably part of an openable window or configured as a folding-sliding element. An openable window can be configured as a one-winged side-hung window, as a French casement window with two rotary wings, as a bottom-hung window, as a top-hung window, as a pivoting window, as a reversible window, or as a sliding window. The sliding window can be slidable sideways, upwards, downwards, or up- and downwards.

Preferably, the multifunctional glass element has smaller dimensions than a glass element arranged outside on the front. This makes it easier to modify the position of the multifunctional glass element in the vertical direction and/or the horizontal direction, but also a possible exchange of the multifunctional glass element if repair work is to be carried out or if said multifunctional glass element is to be replaced by a multifunctional glass pane with an extended range of functions.

According to a preferred embodiment of the invention, the curtain wall further comprises an integrated sun protection provided either as a separate sun protection element or as a switchable layer in the outer glass element on the front. Such an integrated sun protection can detect the amount of solar radiation via sensors and, accordingly, regulate the sun protection automatically.

The building envelope according to the invention is characterized in that the multifunctional glass element is arranged on the room side at a distance between 50 mm and 500 mm from an adjacent inner wall of the building envelope. In this respect, the expression "on the room side" is to be understood such that the multifunctional glass element is located in the room behind the inner wall of the building envelope in the specified distance area. The upper limit of 500 mm is less due to technical requirements, but is chosen in order not to waste the existing space by a distance that has been chosen too large.

Preferably, the multifunctional glass element extends over the full width of the room and/or over the full height of the room. Alternatively, however, it is also possible that the multifunctional glass element only extends over a section of the room, such as over a height of 1000 mm to 2500 mm, but over the full width of the room, or that it is arranged only in a central area with respect to the width and height of the room, for example if the multifunctional glass element is supposed to be facing specific workplaces.

The function of anti-glare protection in the form of modifiable or switchable layers is preferably configured in the form of laminated glass. The provision of room lighting is preferably realized by integrating the LEDs into the composite material of casting resin between the glass panes. The LEDs can be provided evenly over the surface of the multifunctional glass element or in any strip-shaped arrangements. It is also possible to grade the density of the LEDs continuously or discontinuously over the height of the multifunctional glass element.

If the multifunctional glass element has the function of an information system, a screen, for example, can also be provided over the entire surface, or can be located only in sections of the multifunctional glass element, particularly preferably in its center.

A building with the curtain wall according to the invention is preferably configured such that each multifunctional glass element is assigned to a specific room of the building, so that it can be operated and controlled from the inside of the room. Depending on the room size, a plurality of multifunctional glass elements can be located in a single room, of course.

BRIEF DESCRIPTION OF THE DRAWINGS

Hereinafter, the invention will be described, purely by way of example, by means of the enclosed figures, with FIG. 1 showing a vertical section through a unitized front;

FIG. 2 showing a vertical section through a post and beam front;

FIG. 3*a* to

Figures 1, 2, 3A, 3B, 3C, 3D:
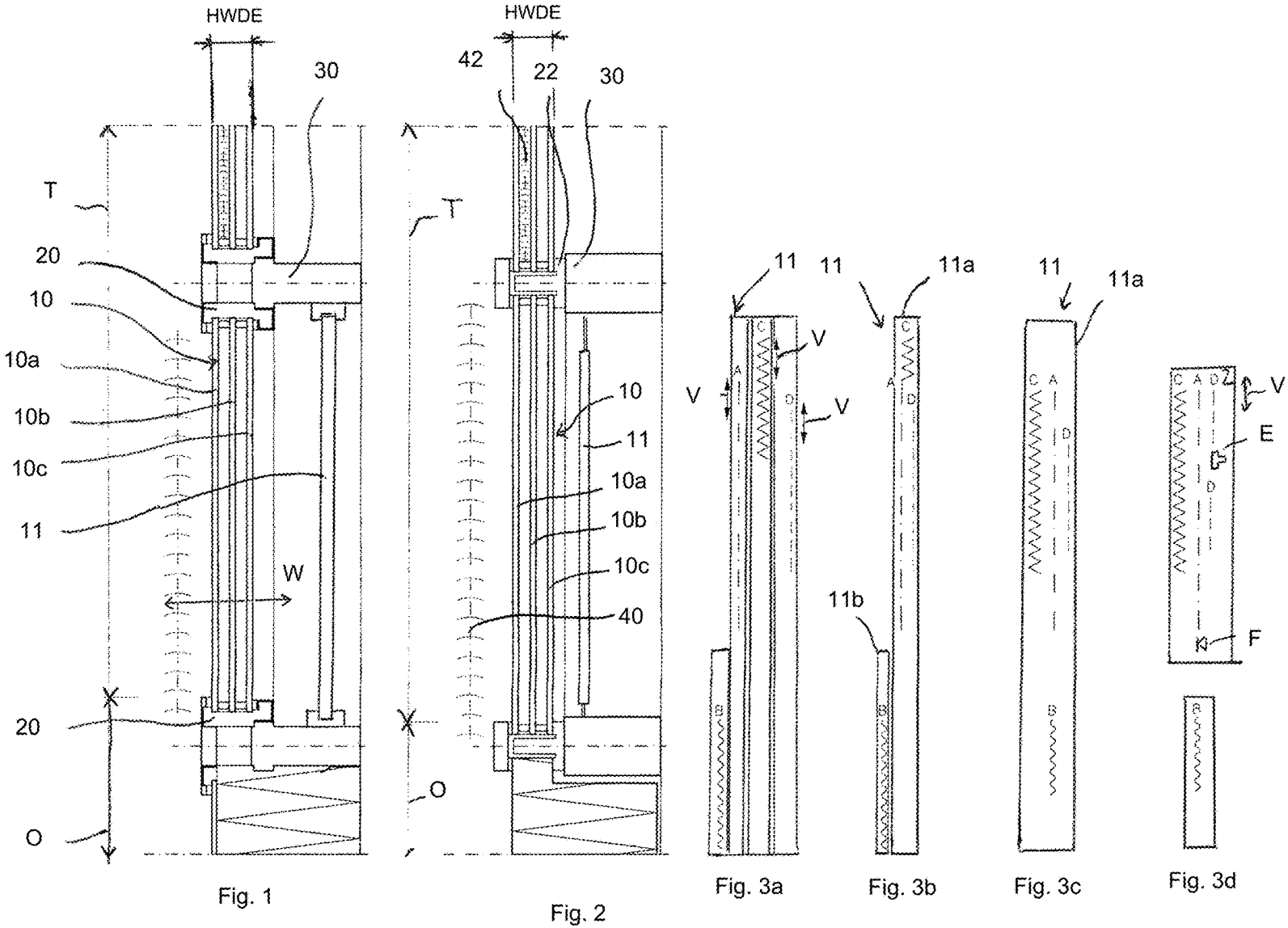
Figure 4:
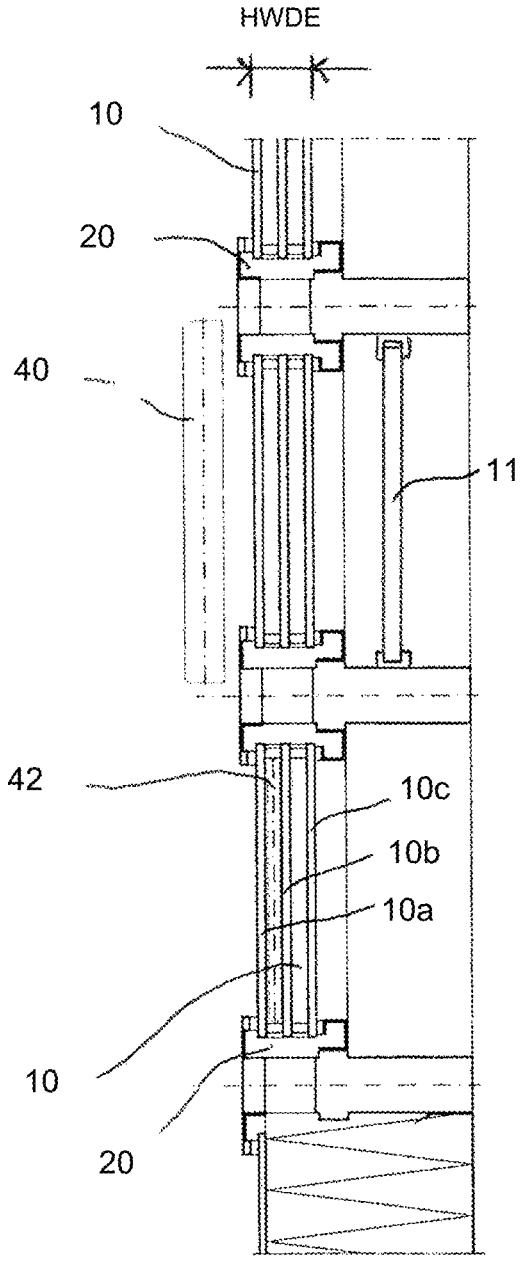
Figure 5:
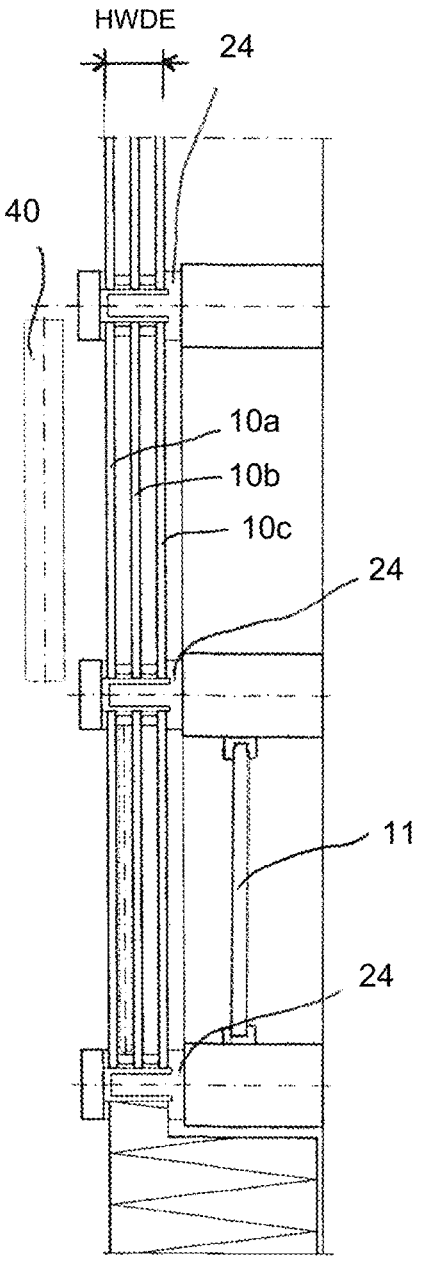
Figure 6:
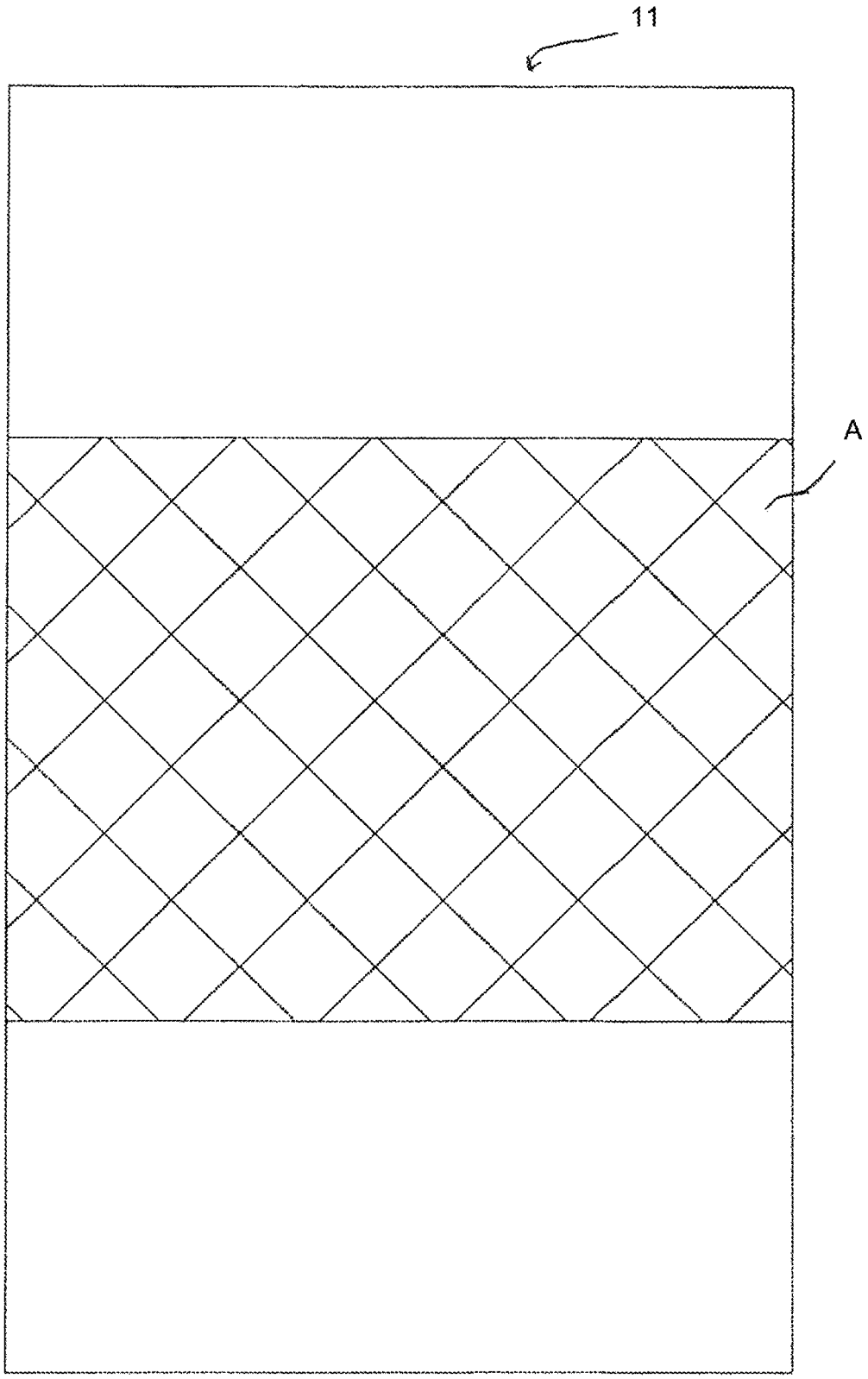
Figure 7:
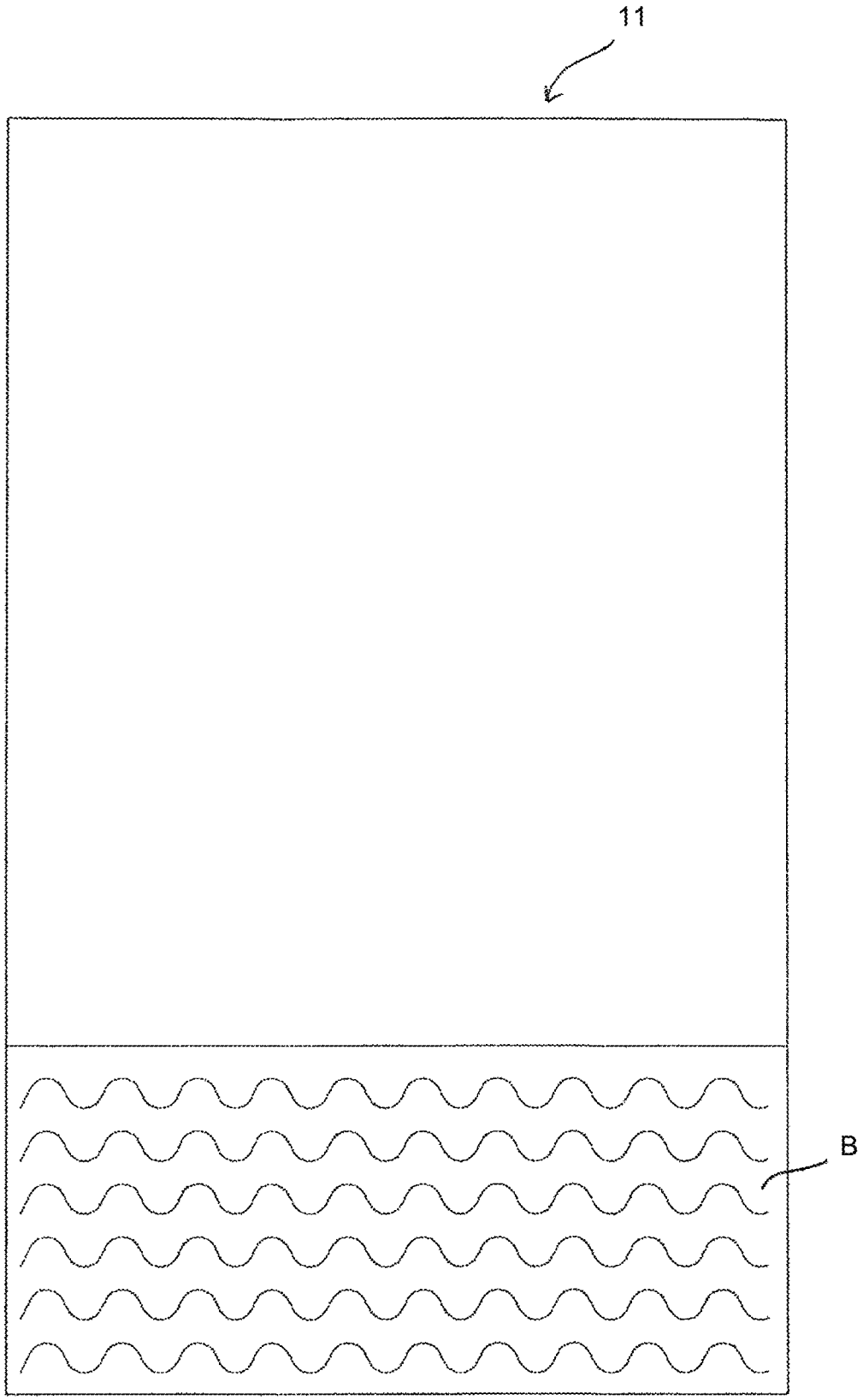

FIG. 3*d* showing various possible arrangements of four functions each on a multifunctional glass element;

FIG. 4 showing a horizontal section through a unitized front;

FIG. 5 showing a horizontal section through a post and beam front;

FIG. 6 showing the possible arrangement of anti-glare protection in a multifunctional glass element;

FIG. 7 showing the possible arrangement of the heating capacity function in a multifunctional glass element;

FIG. 8 and

Figure 9:
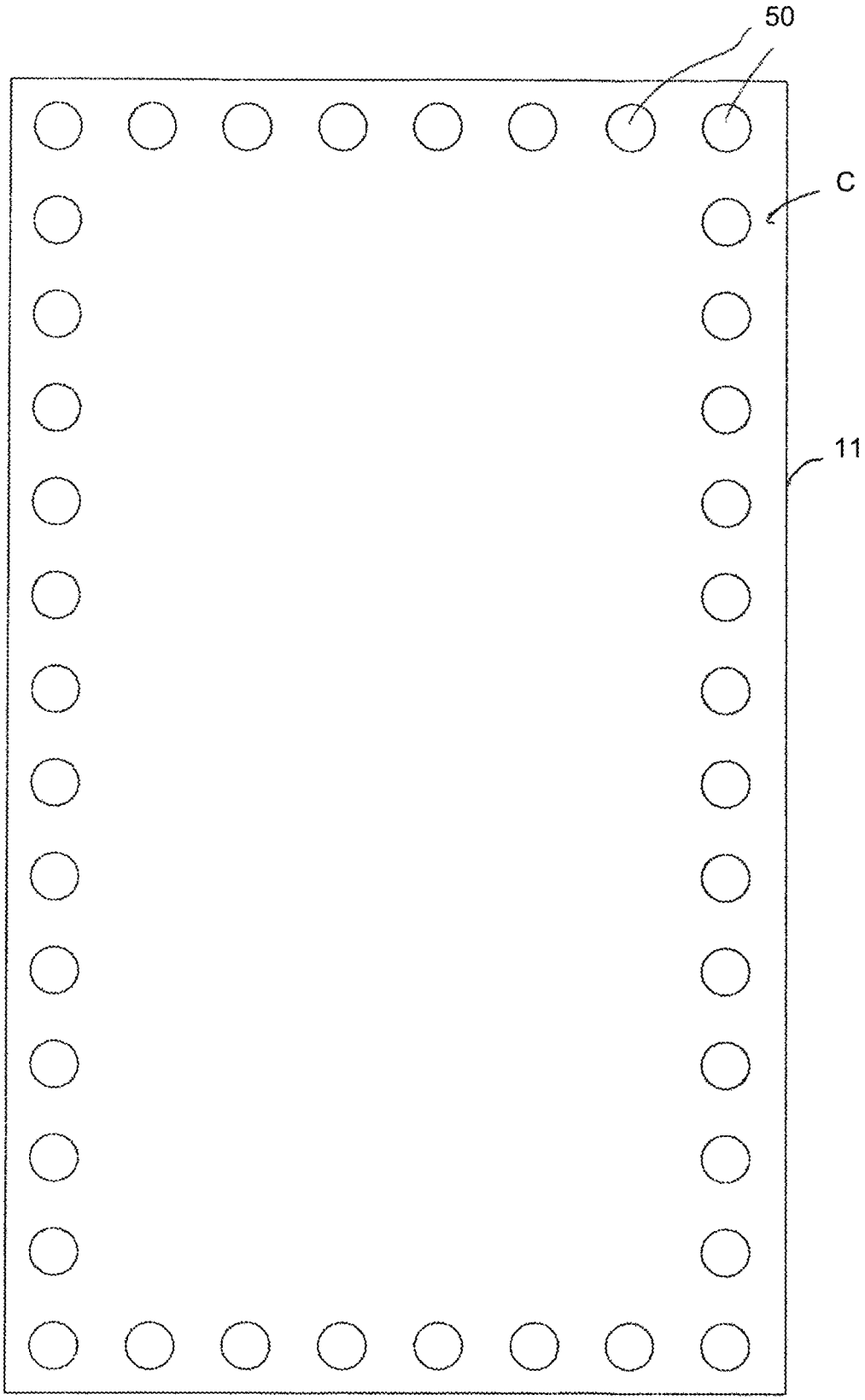
Figure 10:
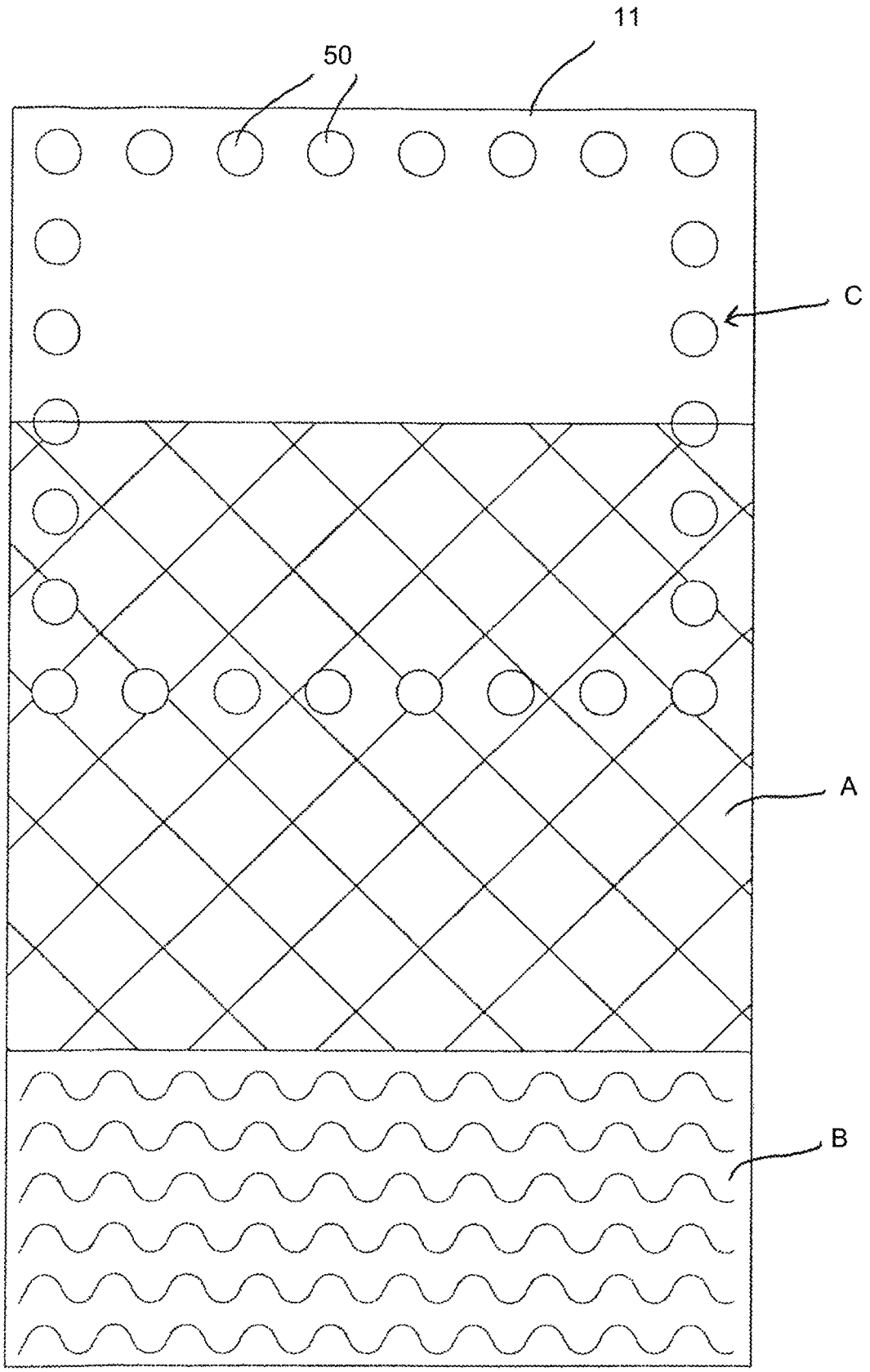
Figure 11:
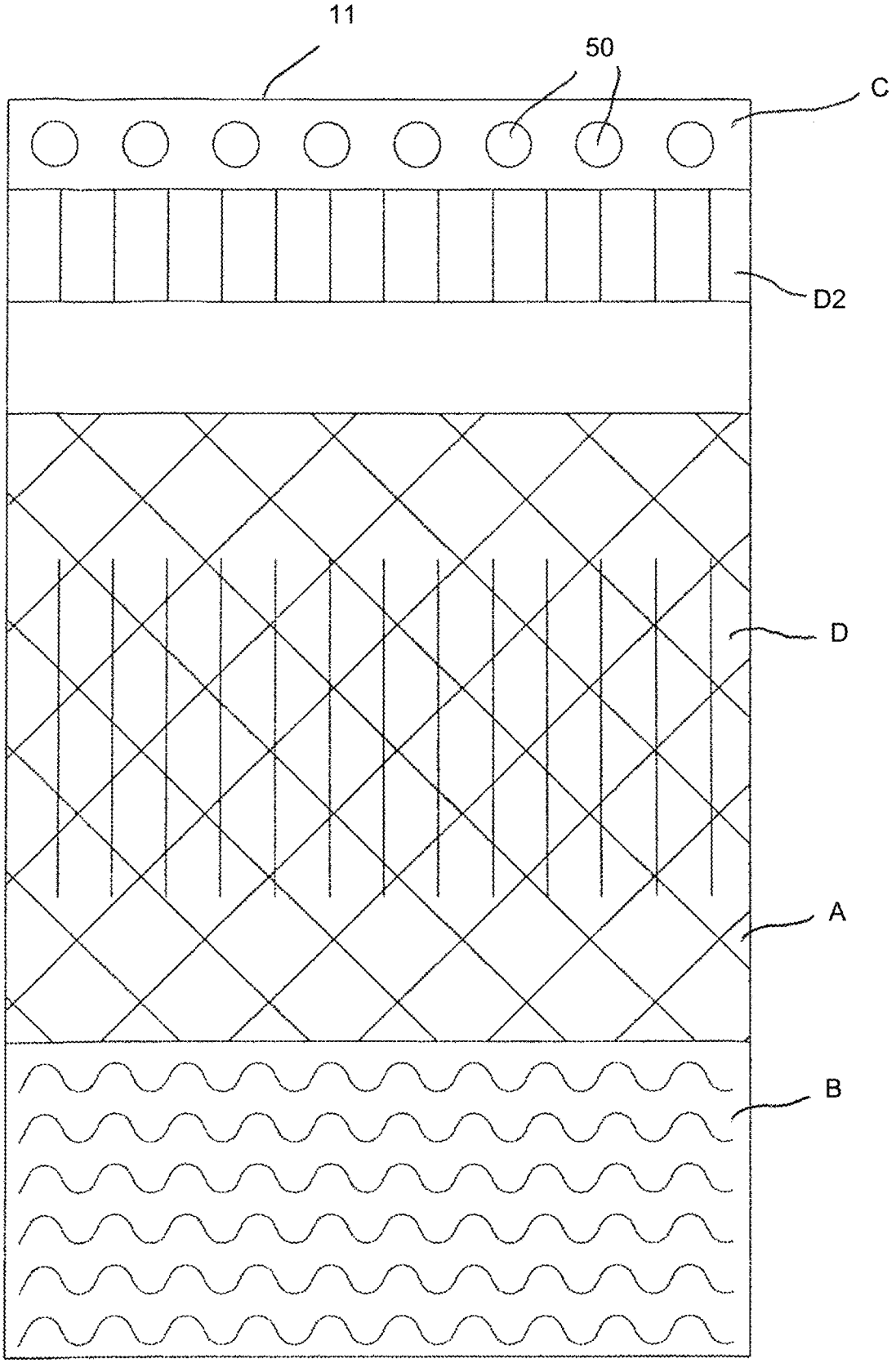
Figure 12:
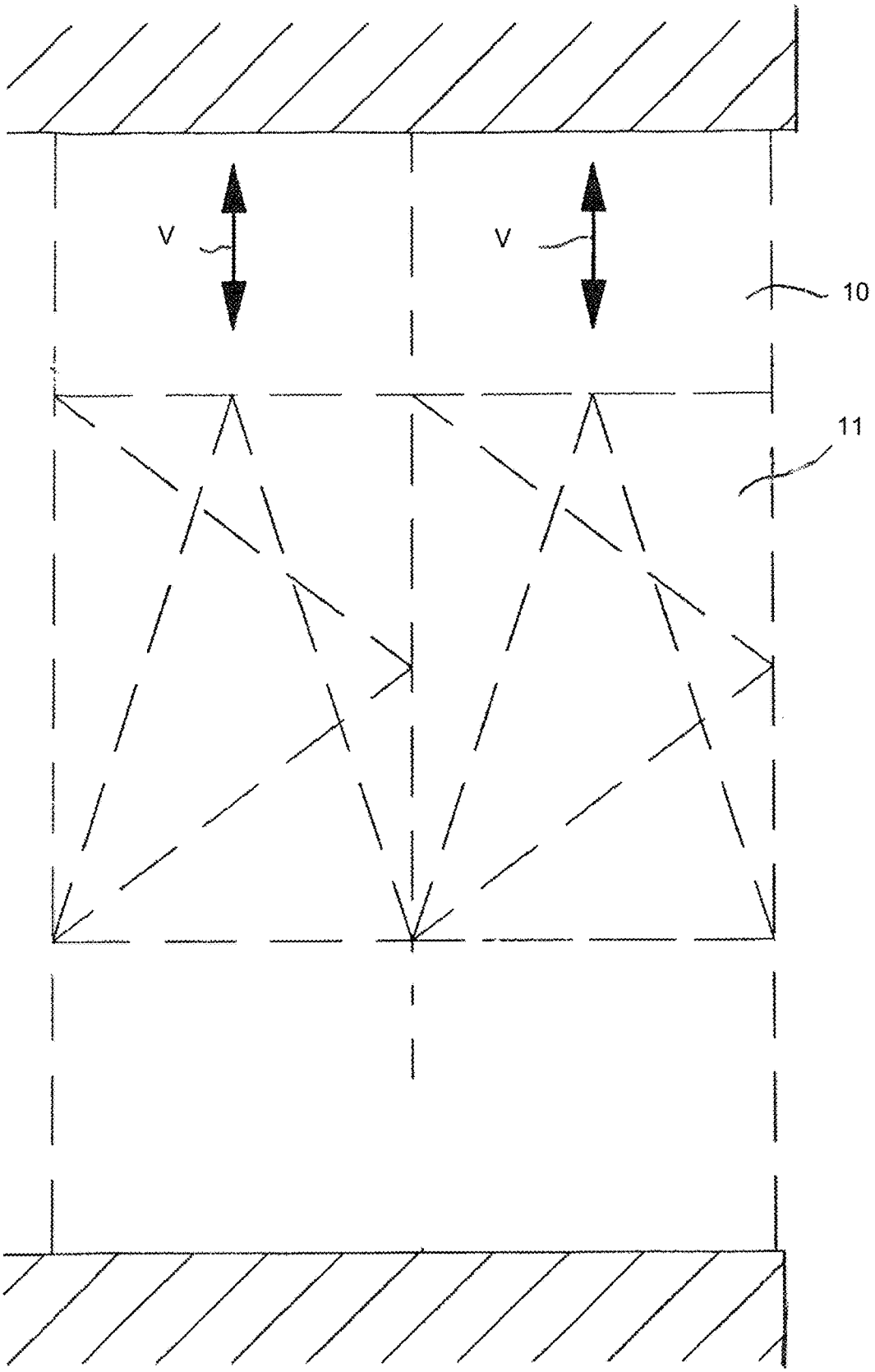
Figure 13:
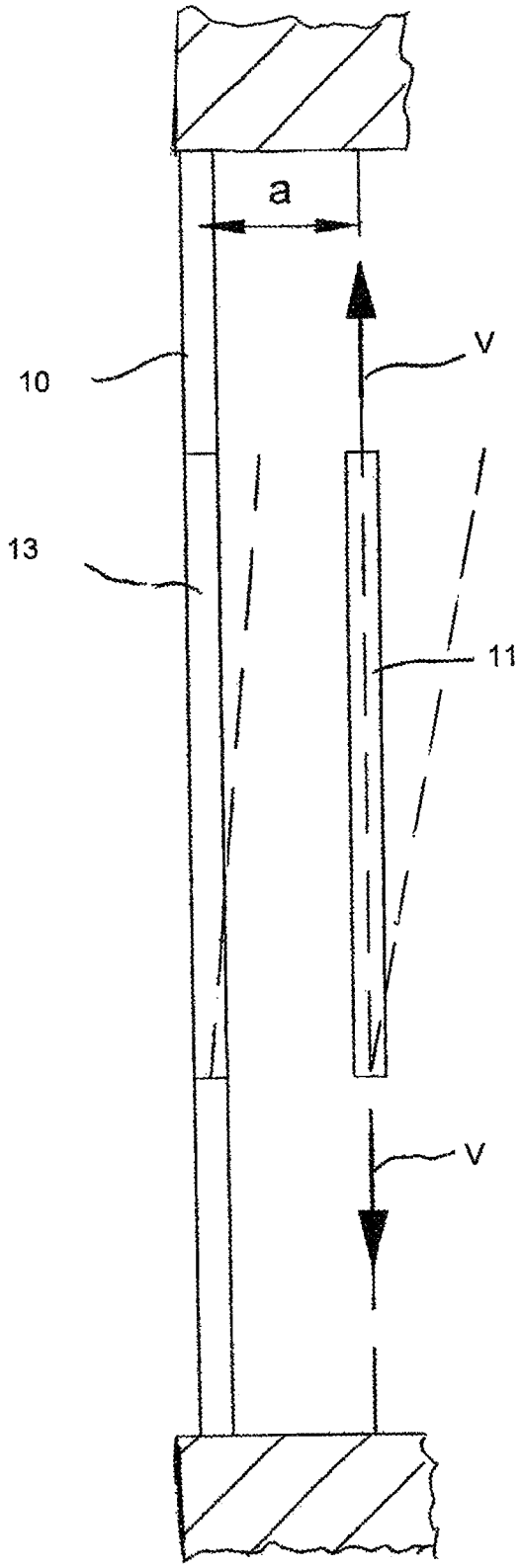

FIG. 9 showing possible arrangements of the functions of the configuration as room lighting of the multifunctional glass element;

FIG. 10 showing the possible arrangement of several different functions on a multifunctional glass element;

FIG. 11 showing a further variant of a multifunctional glass element with the spatial arrangement of four functions;

FIG. 12 showing the slidable arrangement of a multifunctional glass element; and FIG. 13 showing a side view of the front shown in FIG. 12.

WAYS OF IMPLEMENTING THE INVENTION

In the following figures, the same elements will be designated with the same reference numbers.

FIG. 1 shows a schematic vertical section through a building envelope according to the invention with a unitized front. As can be seen, the glazing 10 of the unitized front is provided as triple glazing with the individual glass elements 10*a*, 10*b* and 10*c*. The glass elements are firmly premounted in a framework 20 and fixed to the building shell 30 during construction. In the vertical sectional view shown, a transparent zone T and an opaque zone O are apparent. The main heat-insulating plane HWDE is located in the area of the glass elements 10*a*, 10*b* and 10*c* arranged at a distance from each other in the heat flow direction W. The main heat-insulating plane permanently separates the outdoor climate and the indoor climate from each other. In the present case, the main heat-insulating plane consists of the heat-insulated frame profiles and the infills in the form of insulating glasses and heat-insulated panels, which are integrated therein. The glass element 11*c* is configured as a multifunctional glass element, as will be explained in detail below by means of numerous examples.

The variants of providing a sun protection, which are also shown in FIG. 1, will be explained below by means of FIG. 2.

FIG. 2 shows a vertical section through a building envelope according to the invention with a post and beam front which differs from the unitized front according to FIG. 1 in that the assembly of the curtain wall from post and beam profiles as well as the insertion and fixing of the infill elements 10 is carried out on the construction site. For this purpose, the beams 22 are fixed to posts and, after the post and beam frame has been created, the glass elements 10 are inserted. As in the embodiment according to FIG. 1, the glass elements 10 again consist of triple glazing with the individual glass panes 10*a*, 10*b* and 10*c*. On the inside of the front is a multifunctional glass element 11.

Located on the inside of the front with respect to the main heat-insulating plane is the multifunctional glass element 11 described in more detail below.

In addition, the post and beam front according to FIG. 2 is provided with a sun protection. This can be configured either in the form of a sun protection 40 arranged on the outside of the front, for example in the form of motor-adjustable lamellas, or in the form of an internal sun protection 42 arranged in the intermediate space between the glasses. Alternatively (not shown), however, the outer glass 10*a* can also be configured such that it has a switchable layer.

FIGS. 3*a* to 3*d* show various possibilities of how the multifunctional glass element can be configured. In conformity with the designation in claim 1, the functionalities are designated as A to D.

In the embodiment according to FIG. 3*a*, four separate functionalities are provided. These are the anti-glare protection A by the glass, the heating capacity B of the glass, the configuration with integrated LEDs as room lighting C as well as the configuration of the multifunctional glass element as an information system D by providing a screen.

The glass panes with the anti-glare protection, the lighting and the information system are slidable in the vertical direction V. The glass pane with the heating capacity B is preferably horizontally slidable, so that in times when room heating is not necessary, it can be slided into an area where the corresponding glass pane is not visually disturbing. Preferably, each pane can be moved separately, so that, for example, the room lighting or the screen can be brought into the desired position separately.

In the embodiment according to FIG. 3*b*, the functionalities A, C and D, i.e. the anti-glare protection A, the lighting C and the information system D are integrated in a multifunctional glass element with a single glass pane 11*a* which is configured as multiple laminated glass, for example. The lighting C is arranged at an upper edge of the multifunctional glass element above the anti-glare protection, whereas the information system D in the form of a screen is located in a central section of the anti-glare protection. The functionality of heating B is provided in a separate pane 11*b*. Due to the suitable arrangement of the functionalities in accordance with the usual requirements, there is no need for a separate slidability of the individual panes in the embodiment according to FIG. 3*b*; however, a vertical and/or horizontal slidability is also possible in the embodiment according to FIG. 3*b*.

In the embodiment example according to FIG. 3*c*, the functions A, B, C and D are arranged in a single glass pane 11*a*. In this respect, the anti-glare protection A is located in a central main surface of the multifunctional glass element, and the integrated LEDs as room lighting C are arranged laterally with respect to A in the form of a vertically arranged edge around the centrally arranged anti-glare protection A. As is already the case with the embodiments according to FIGS. 3*a* and 3*b*, the screen as information system D is arranged in the central section of the anti-glare protection A. The functional layer with the functionality of heating capacity B follows below the area with the anti-glare protection A.

In the embodiment according to FIG. 3*d*, all functionalities A, B, C, D, E, F are integrated into the multifunctional glass element. In addition to the anti-glare protection A, the heating capacity B arranged separately below the other functions, the lighting C and the information system D, one or more integrated cameras E as well as one or more integrated loudspeakers F are thus also provided. Also in this embodiment, the heatable glass B can be accommodated below the anti-glare protection A by the glass in a separate pane should a separate positioning of the pane with the heating capacity be desired. In the embodiment according to FIG. 3*d*, the information system D is also divided into two sections. In addition to the information system D in the form of a screen, which is arranged in the central area of the anti-glare protection, a media strip D2 is also provided in the upper area.

FIGS. 4 and 5 each show horizontal sections through the unitized front (FIG. 4) as well as the post and beam front (FIG. 5), the vertical sections of which have already been shown in FIGS. 1 and 2. FIG. 5 shows the posts 24 of the front, the center-to-center distance of which is arbitrary, but which are preferably arranged at a distance between 1 m and 5 m from each other. The same applies to the dimensions of the individual elements of the unitized front with the frame 20 and the glazing 10. Also shown in FIGS. 4 and 5 are in turn an external sun protection 42 as well as a sun protection 42 arranged at a distance between the glass elements 10*a* and 10*b*. A multifunctional glass element 11 is arranged in each case towards the inside of the room behind the main heat-insulating plane HWDE of the front.

FIG. 6 shows a multifunctional glass element 11 in which the anti-glare protection B illustrated by means of a hatched area is located only in a central position of the multifunctional glass element 11. This represents the preferred position since in the upper area of the pane a sufficient amount of light can reach the interior of the building, while at the same time anti-glare protection is ensured in the area of interest for living or working purposes when people are standing or sitting in the room. Further functionalities of the multifunctional glass element 11 according to FIG. 6 were not included since it is only the preferred arrangement of the anti-glare protection that matters.

Also in the illustration according to FIG. 7, additional functionalities and their arrangement in addition to the heating capacity B were not included. The heatable area B is preferably located in the vertical direction at the bottom of the multifunctional glass element 11, so that cold air on the inside of the multifunctional glass element arranged towards the inside of the room is heated by the heated air rising upwards and is prevented from forming a cold layer on the floor of the room, which is perceived as uncomfortable.

Figure 8:
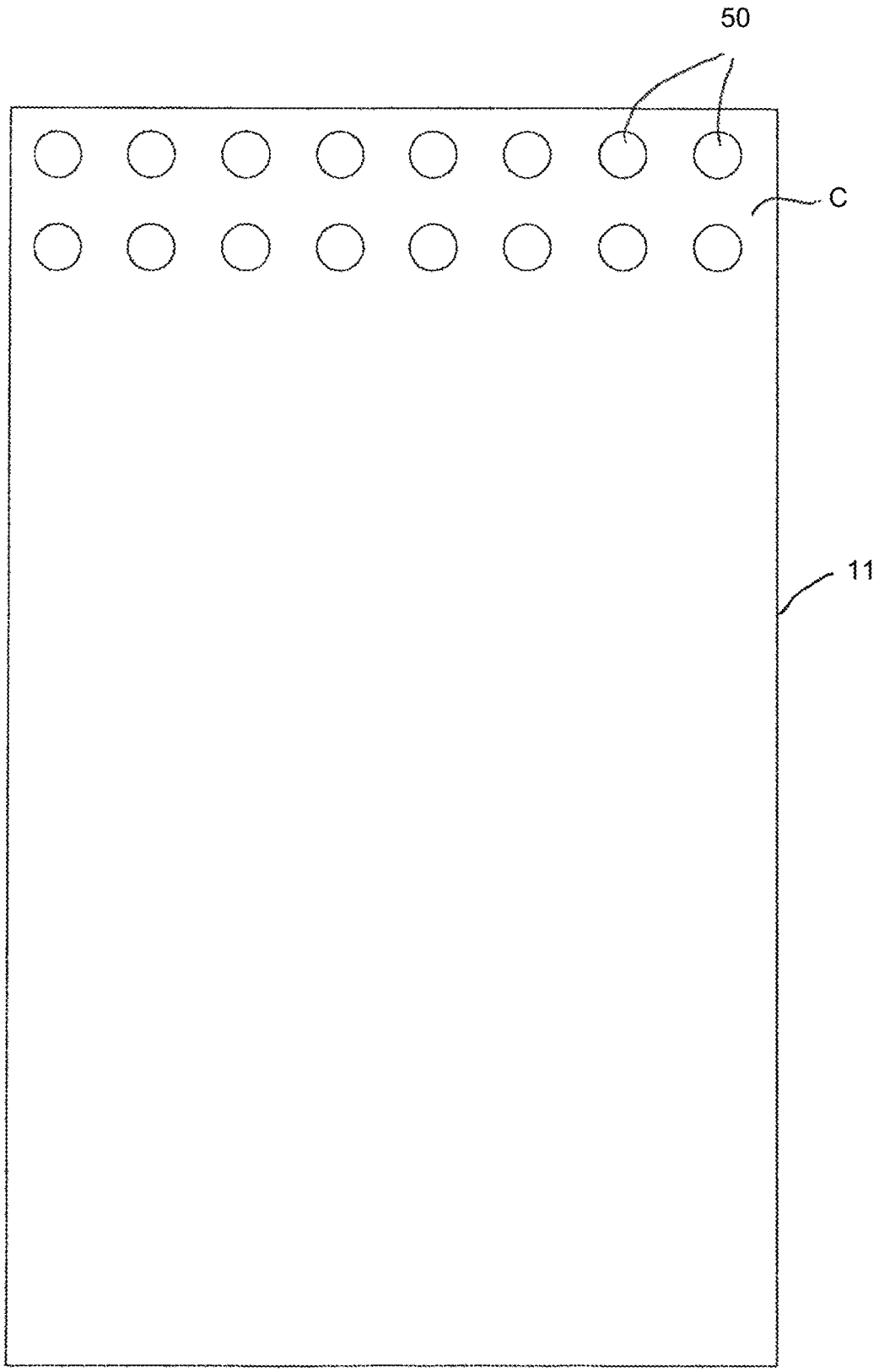

The illustration according to FIG. 8 also focused only on one possible arrangement of the functionality as room lighting C with individual LEDs 50. In this respect, the LEDs 50 were only illustrated schematically and significantly enlarged as compared to the dimensions of a common multifunctional glass element 11. Many conceivable positions are possible for arranging the room lighting C, but the arrangement of LEDs as room lighting at the top of the multifunctional glass element 11 as well as the arrangement according to FIG. 9 in the form of a completely or partially surrounding frame are conceivable arrangements. Also in the illustration according to FIGS. 8 and 9, further functionalities and their placement relative to the room lighting C were not included.

In the embodiment according to FIG. 10, the functionalities of anti-glare protection A, heating capacity B as well as room lighting C by means of individual LEDs 50, which are described individually in the previous embodiments, are shown in combination. In addition to a preferably centrally arranged anti-glare protection area A as well as an area B preferably arranged at the bottom, which is heatable, the LEDs 50 are shown as room lighting C in the form of a frame which is located in the upper area of the multifunctional glass element 11.

In the embodiment according to FIG. 11, further functionalities are provided. In addition to anti-glare protection A centrally arranged on the multifunctional glass element 11, a heatable area B is provided in the lower area and adjacent to the anti-glare protection area A. Similar to the illustration according to FIG. 8, room lighting C with LEDs 50 is provided at the upper edge of the multifunctional glass element 11. Moreover, an information system D is provided, which is provided as a screen in the central area and overlaps with the area of the anti-glare protection A. In addition to this information system D, a further area D2 is provided which is arranged below the room lighting C and above the anti-glare protection A and which can also be used as an information system.

Some of the individual areas can be controlled automatically, such as the anti-glare protection A or the heating B, or they can be controlled via a suitable medium. This can be done in the form of a remote control, for example, but also with the aid of a suitable app, so that authorized persons or groups of persons can control the room lighting C or one or more information systems D, D2 via their smartphone. For this purpose, the multifunctional glass element is provided with a suitable sensor technology which, for example, detects the lighting situation, the presence of people in the room via a motion sensor, or also the room temperature by means of suitable temperature sensors.

FIG. 12 shows how a multifunctional glass element, when viewed from the inside of the room, can be arranged relative to the glass element 10 of the curtain wall and provided so as to be slidable in the vertical direction V. The provision of suitable and preferably self-locking sliding means and rail constructions is at the discretion of the person skilled in the art who is familiar with various sliding solutions in the field of window technology.

FIG. 13 shows a vertical section through the building envelope according to the invention as shown in FIG. 12. The glass element 10 can comprise an openable element 13. The multifunctional glass element 11, which can comprise several individual glass panes according to the illustration in FIG. 3*a*, for example, is preferably arranged at a distance a between 50 mm and 500 mm from the glass element 10 and can also be configured as an openable window or as a folding-sliding element.

All the embodiments shown have in common that the multifunctional glass element combines various functions and is slidable in its horizontal and/or vertical direction. In principle, all functions of the glasses can be activated differently, such as LEDs that can be adjusted differently. Consequently, the multifunctional glass element contains several functions at the same time beyond the pure function of a glass pane, wherein the multifunctional glass element is always directed towards the inside of the room and arranged behind the main heat-insulating plane of the building envelope.

According to a further embodiment which is not a subject matter of the invention, the glass pane on the inside of the front is configured as a multifunctional glass element which can have all the properties described herein.

The invention claimed is:

1. A building envelope comprising a curtain wall, having a frame construction with a plurality of glass elements arranged at a distance from each other in a heat flow direction, and a multifunctional glass element fixed to the curtain wall provided in addition to the glass elements of the curtain wall and arranged on a room side behind a main heat-insulating plane of the curtain wall, wherein the multifunctional glass element is slidable in a vertical direction or a horizontal direction while fixed to the curtain wall; and wherein the multifunctional glass element has at least two functions selected from the group consisting of:

(A) anti-glare protection comprising modifiable or switchable layers;

(B) heating capacity in sections;

(C) integrated LEDs as room lighting;

(D) an information system as a screen in sections;

(E) at least two integrated cameras; and (F) at least two integrated loudspeakers.

2. The building envelope of claim 1, wherein the multifunctional glass element has at least three of the functions selected from the group consisting of (A) to (F).

3. The building envelope of claim 1, wherein the multifunctional glass element has at least four of the functions selected from the group consisting of (A) to (F).

4. The building envelope of claim 1, wherein the multifunctional glass element comprises laminated glass.

5. The building envelope of claim 1, wherein the multifunctional glass element comprises a double-glazed pane with individual panes with an intermediate space between 4 mm and 20 mm between the individual panes, wherein the individual panes can be moved separately.

6. The building envelope of claim 5, wherein the at least two functions of the multifunctional glass element are distributed over the individual panes.

7. The building envelope of claim 1, wherein the at least two functions of the multifunctional glass element are arranged in spatially separated areas.

8. The building envelope of claim 1, wherein the at least two functions of the multifunctional glass element are arranged in overlapping areas.

9. The building envelope of claim 1, wherein the multifunctional glass element comprises an openable window or a folding-sliding element.

10. The building envelope of claim 1, wherein the multifunctional glass element has smaller dimensions than a glass element arranged outside on a front of the curtain wall.

11. The building envelope of claim 1, further comprising an integrated sun protection provided as a separate sun protection element or as a switchable layer in an outer glass element on a front of the curtain wall.

12. The building envelope of claim 1, wherein the multifunctional glass element is arranged on the room side at a distance between 50 mm and 500 mm from an adjacent inner wall of the building envelope.

13. The building envelope of claim 12, wherein the multifunctional glass element extends over a full room height.

14. The building envelope of claim 13, the multifunctional glass element extends over a full width of a room.

15. A building envelope comprising a curtain wall having a frame construction with a plurality of glass elements arranged at a distance from each other in a heat flow direction, and a multifunctional glass element fixed to the curtain wall provided in addition to the glass elements of the curtain wall and arranged on a room side behind a main heat-insulating plane of the curtain wall, wherein the multifunctional glass element is slidable in a vertical direction and a horizontal direction while fixed to the curtain wall; and wherein the multifunctional glass element has at least two functions selected from the group consisting of:

(A) anti-glare protection comprising modifiable or switchable layers;

(B) heating capacity in sections;

(C) integrated LEDs as room lighting;

(D) an information system as a screen in sections;

(E) at least two integrated cameras; and (F) at least two integrated loudspeakers.

* * * * *